United States Patent [19]

Chuang

[11] Patent Number: 4,617,541

[45] Date of Patent: Oct. 14, 1986

[54] ELECTROMAGNETIC STARTER FOR REVERSIBLE MOTOR

[75] Inventor: Chiu-Hsiung Chuang, Taipei, Taiwan

[73] Assignees: Pen-Ho Huang, Taipei, Taiwan; Gordon Kuo-Chon Chang, New York, N.Y. ; a part interest to each

[21] Appl. No.: 776,640

[22] Filed: Sep. 16, 1985

[51] Int. Cl.[4] ..... H01H 63/02; H01H 67/02

[52] U.S. Cl. ..... 335/133; 335/103; 335/107; 335/119; 335/131; 335/136

[58] Field of Search ..... 335/103, 107, 119, 120, 335/131, 133, 136, 163, 162, 161, 160, 159

[56] References Cited

U.S. PATENT DOCUMENTS

| | | | |
|---|---|---|---|
| 2,446,299 | 8/1948 | Nelsen | 335/120 |
| 2,946,872 | 7/1960 | Siebers | 335/121 |
| 4,506,245 | 3/1985 | Lerude | 335/160 |

FOREIGN PATENT DOCUMENTS

| | | | |
|---|---|---|---|
| 528059 | 4/1954 | Belgium | 335/133 |

*Primary Examiner*—E. A. Goldberg
*Assistant Examiner*—Lincoln D. Donovan
*Attorney, Agent, or Firm*—Charles E. Pfund

[57] ABSTRACT

A starter for a reversible motor has a single outer casing and one operating switch for controlling the forward or reverse rotation of the motor. The starter uses only ten pairs of electric contacts instead of the twenty pairs of contacts in a conventional starter. A safety means is provided which can turn off the undesired actuation circuit of the electromagnet. And another important feature of the starter is an adjustable screw with a coil spring sleeved thereon to assure the right movable contacts being closed in the starter without closing undesired contacts.

5 Claims, 11 Drawing Figures

ELECTROMAGNETIC STARTER FOR REVERSIBLE MOTOR

BACKGROUND OF THE INVENTION

The present invention relates to a starter for a reversible motor, especially to an electromagnetic starter.

Reversible motors are very commonly used in various situations. A conventional starter for a reversible motor, sometimes commercially known as a "magnetic contactor", usually consists of two sets of electromagnetic actuators having two movable plates with twenty pairs of electric contacts mounted thereon. All of the working elements together with their necessary accessories are assembled within several, usually two cases. Although the elements of the whole starter can be installed in a single case, several disadvantages of conventional starters still exist.

The above-stated motor starter occupies a large space on the switching board. It is easily damaged or put out of adjustment of junction due to its too many movable parts and contacts. Besides, there is no safe means of avoiding accidental switching of the direction of rotation.

SUMMARY OF THE INVENTION

It is the main object of the present invention to provide an electromagnetic starter for reversible motors having a compact structure with a minimized volume, the least number of movable parts and electric contacts, and a very simple circuitry.

Another object and also a very important feature of the present invention is to provide a starter having a safety guard apparatus preventing the short circuit of the motor from forward rotation to reverse rotation.

A further object of the present invention is to provide a starter for reversible motors having only ten pairs of elecctrical contacts instead of twenty pairs as in conventional starters.

Therefore, an electromagnetic starter for reversible motors of the present invention consists of an outer casing for the installation of the necessary members of the starter; a movable member having a plurality of electrical contacts attached thereon and at least two pins protruding from one surface thereof; a fixed member having a plurality of electrical contacts corresponding to the electrical contacts on the movable member, pins opposing to the pins on the movable member and a plurality of elelctrical conduction plates extending from each contact forming a normaly close connection of each pair of electrical contacts; a bias spring installed between the movable member and the fixed member and supported by the pins thereof; and a pair of electromagnets each having a movable iron core connected to the movable member by a pair of connecting members. When either of the electromagnets is actuated, the movable iron core will cause the movable member to move as a fulcrum with respecct to the pins and causing in turn the contact of the corresponding electric contacts on the movable and the fixed members. Then the reversible motor will rotate in the direction desired.

BRIEF DESCRIPTION OF THE DRAWINGS

Those and other advantages, objects and features of the present invention will become apparent from the following detailed description of the preferred embodiments with reference to the accompanying drawing, wherein.

DETAILED DESCRTPTION OF THE PREFERRED EMBODIMENT

Figure 1:
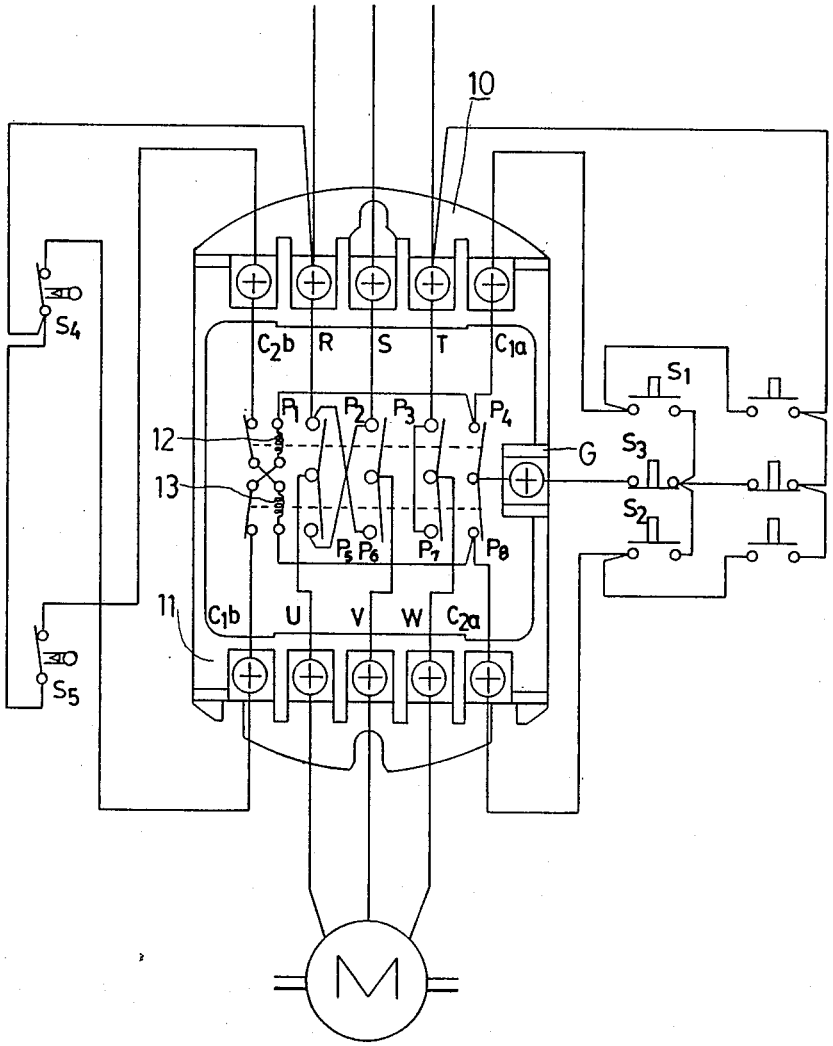
FIG. 1 is an illustrative schmatic diagram of the circuitry using an embodiment of the electromagnetic starter of the present invention.

Referring to FIG. 1 which shows an illustrative diagram of the electromagnetic starter of the present invention, the starter 10 has an outer casing 11 for the assembly of the members in the starter. There are five junctions on each side of the starter 10, namely C2*b*, R, S, T, C1*a*, C1*b*, U, V, W, C2*a*, and another junction G for grounding. In the present embodiment, a circuitry of a three phase four lines system is provided wherein junctions R, S and T are connected to the power source and junctions U, V and W are connected to the reversible motor M. Junctions C1*a* and C1*b* are so connected in series to switch S1, coil 12 and over current protection switches S4 and S5 as to form the forward rotation actuating circuit. Once the switch S1 is on, the coil 12 is actuated to cause the contacts P1 through P4 to close and electric power is fed to the reversible motor M for forward rotation. Likewise, junctions C2*a*, C2*b*, coil 13 and switches S2, S4, S5 form a reverse rotation actuating circuit. When switch S2 is closed, the coil 13 will be actuated to cause the electric contacts P5 through P8 to close. Because the first phase and the second phase of the power source are interchanged by the junction R to V and S to U, the motor M is then rotated in a reverse direction. Switch S1 and S2 actually are formed into a single pole double throw switch. Therefore, there is only one operating switch on the outer casing of the starter.

Figure 2:
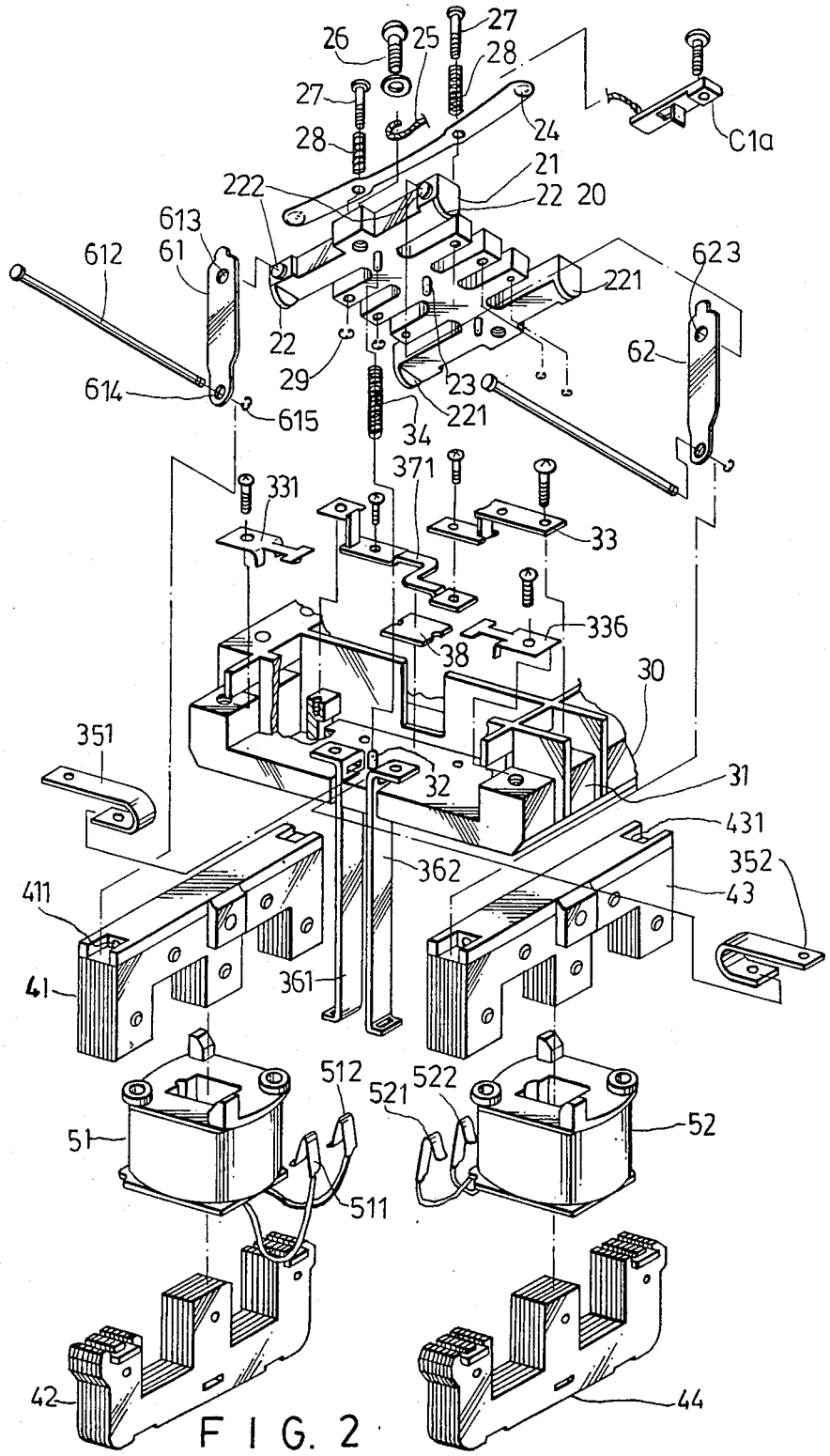
FIG. 2 is an exploded view of an embodiment of the electromagnetic starter according to the present invention.

Referring to FIG. 2 which shows an exploded view of the starter of the present invention, the starter consists three major parts namely an upper movable member portion 20, a middle fixed member portion 30, and a lower electromagnets portion.

Figure 3A:
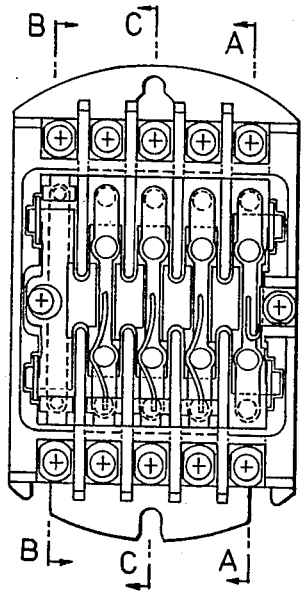
FIG. 3A is an elevated view of the starter showing the movable member.
Figure 3B:
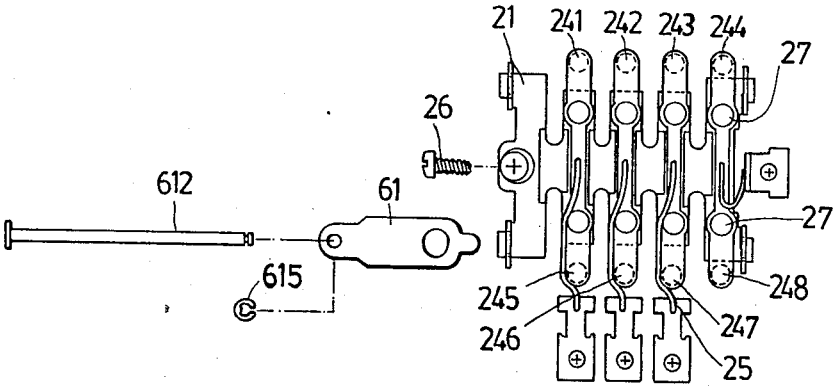
FIG. 3B is an elevated view of the movable member in the starter of the present invention.
Figure 5:
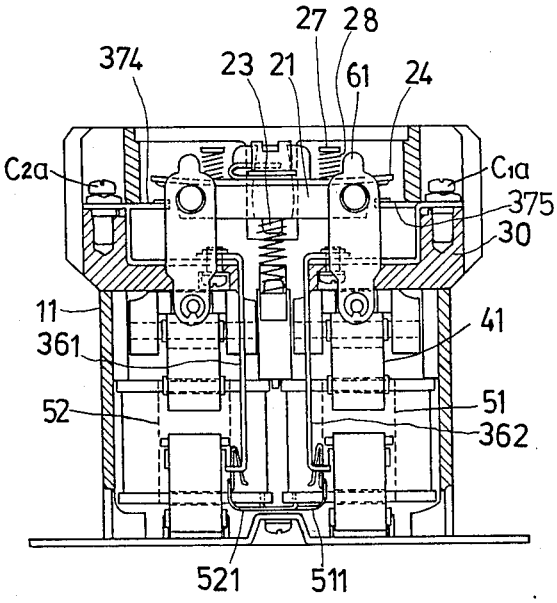
FIG. 5 is a vertical sectional view of the starter according to the present invention.

Referring again to FIG. 2 in conjunction with to FIGS. 3A, 3B and 5, within the upper portion of outer casing 11, there is installed a movable member 20, which consists of a movable body 21 (commercially known as a carrier) in the shape of tree branches, and five electric conduction plates 24 mounted on each branch of the body 21 by a pair of bolts 27 and clips 29 with a coil spring 28 sleeved onto each bolt 27. Each conduction plate 24 may be connected to a junction, for example junction C1*a*, through an electric wire 25 by a screw 26. On one surface of the movable body 21 and along the central dividing line, there are provided a plurality of pins 23 protruding from the surface of the body 21. On the two sides of most branches of the movable body 21, there are two protrusions 22, 221 protruding from downward surface of the end portions thereof. Also on the same branch of the movable body but prodruding from the side surface thereof, there are formed two studs 222 for connection with the electromagnets. Referring particularly to FIG. 3B in conjunction with FIG. 1, it is easy to see that contacts 241, 242, 243 and 244 are the ones labelled P1, P2, P3 and P4 in FIG. 1 while contacts 245, 246, 247 and 248 correspond to contacts P5, P6, P7 and P8.

Figure 4A:
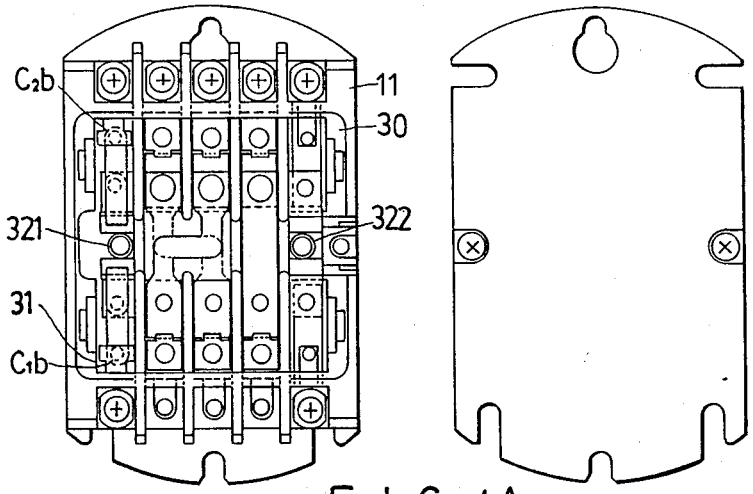
FIG. 4A is a sectional view of the starter of the present invention showing the fixed member.
Figure 4B:
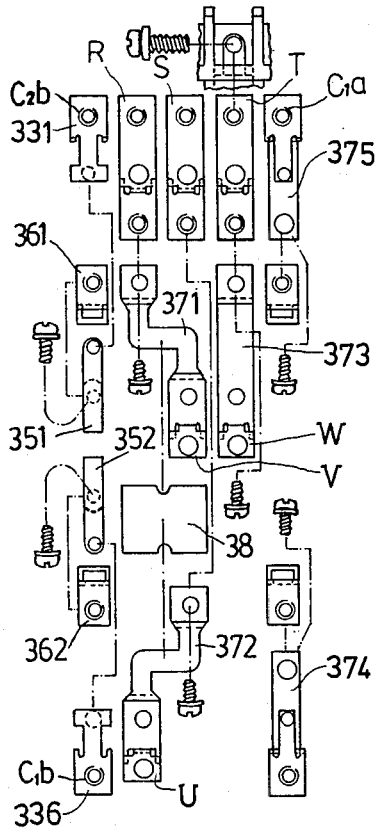
FIG. 4B is an illustrative view of the conduction plates within the fixed member.

Referring still to FIG. 2 in conjunction with FIGS. 4A, 4B and 5, a fixed member 30 forms part of the outer casing, having a cavity therein for the installation of a plurality of fixed electric contacts. Referring particularly to FIG. 4B, contact 331 is secured to the fixed member 30 by a screw. The contact 331 is in contact with a bendable contact 351 which is secured to the base 31 of the fixed member and which is in connection with a vertically arranged electric conduction plate 361. The arrangement of contacts 336, 352 and 362 is exactly the same as that of the contacts 331, 351 and 361. It is to be understood that contacts 331 and 336 are also junctions C2*b* and C1*b*. Junctions R and S are connected to junctions V and U separately by two S-shaped conduction plates 371 and 372. An insulation plate 38 between the conduction plates 371 and 372 is provided for insulation purpose. Junctions T and W are connected by a conduction plate 373. Contacts 375 and 374 form the junctions C1*a* and C2*a*. It is also to be noted that the fixed member 30 is formed into several compartments to isolate the electric conduction plates. There are several pins 32 formed on the inner surface of the fixed member with bias spring 34 sleeved thereon.

Referring again to FIG. 2, in conjunction with FIG. 5, there are two electromagnets 41, 42 and 43, 44 to be actuated by electromagnetic coils 51 and 52. Terminals 512 and 522 of the coil 51 and 52 are grounded, and other terminals 511 and 521 are connected to the vertical conduction plates 362 and 361 respectively. One part of the electromagnet 42, 44 is fixed within the outer casing of the starter while the other part of the electromagnet 41, 43 is movable in a vertical direction with respect to the coil 51, 52. A linking plate 61 having two openings 613 and 614 formed thereon is connected between a part of the electromagnet 41 and the movable member. The opening 613 is sleeved onto the stud 222 on a branch of the movable member. A securing bar 612 passes the opening 614 of the linking plate 61 and the bore 411 of the electromagnet 41 is and secured with a washer 615. Another linking plate can be arranged at the other side of the electromagnet symmetrically with respect to the linking plate 61. This linking plate is not shown in FIG. 2 for the purpose of simplication of the drawings. In the same way, a pair of linking plates 62 can be arranged to link electromagnet 43 and the movable member.

Figure 6:
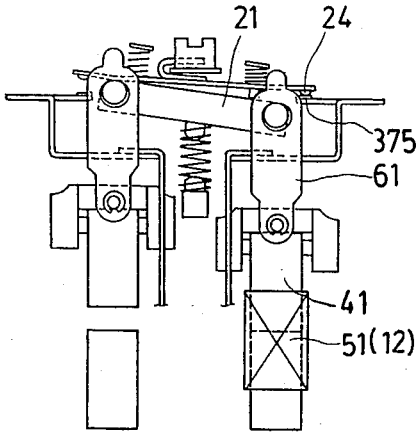
FIG. 6 is an illustrative view showing the operation of the starter sectioned along Line A—A in FIG. 3A.

In operation, please refer to FIG. 6 in conjunction to FIG. 1 wherein FIG. 6 is an illustrative sectional view taken along line A—A in FIG. 3A. When the operating switch is switched to a forward rotation position, i.e. S1 is ON, the electric magnetic coil 51 (12) is actuated to attract the electromagnet 41 to move downwardly. The electromagnet 41 draws the linking plate 61 and in turn draws the movable body 21 of the movable member 20 to move downwardly. All the five electric conduction plates 24 come in contact with the corresponding fixed contacts in the fixed member. In FIG. 6, the contact 24 is in touch with the contact 375 wherein said contact 24 is actually the contact 244 in FIG. 3B. And contacts 245, 246, 247 come in contact with those fixed contacts connected to junctions R, S and T. The electric power is then fed to the reversible motor for a forward rotation.

Figure 7:
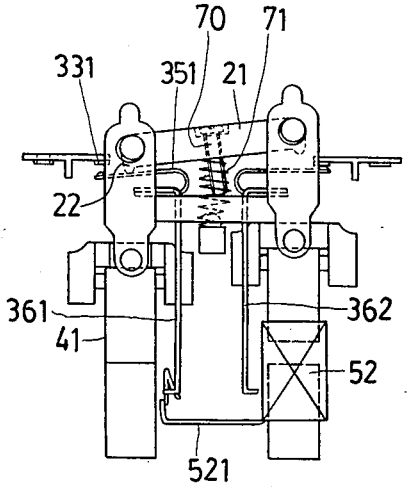
FIG. 7 is another illustrative view showing the operation of the starter of the present invention sectioned along Line B—B in FIG. 3A.

Referring now to FIG. 7 which is an illustrative sectional view taken along line B—B in FIG. 3A, when the movable 21 is drawn by the linking plate to cause a foward rotation of the reversible motor, the protrusion 22 on the branch of the movable body 21 pushes against the bendable contact 351 to keep it separate from the contact 331. The coil 52 will not be actuated since no current will flow from vertical conduction plate 361 and terminal 521 into the coil 52. Therefore, this serves as a safty protection against miss operation of the switch. The present invention may also consist of an adjustable screw 70 protruding downwardly from the surface of the movable body 21 with a coil spring 71 sleeved thereon and biased on the inner surface of the fixed member. When the movable body 21 is inclined on one side, the screw 70 prevents the movable body 21 moving back to its original position unless the linking plate 61 is not further drawn by the electromagnet 41. This screw 70 constitutes another safety protection against misoperation of the starter.

Figure 8B:
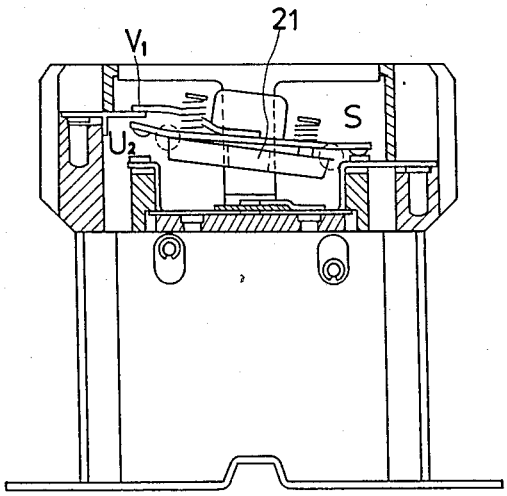
FIG. 8A and FIG. 8B are sectional view of the starter along Line C—C in FIG. 3A showing the operation of the movable member.
Figure 8A:
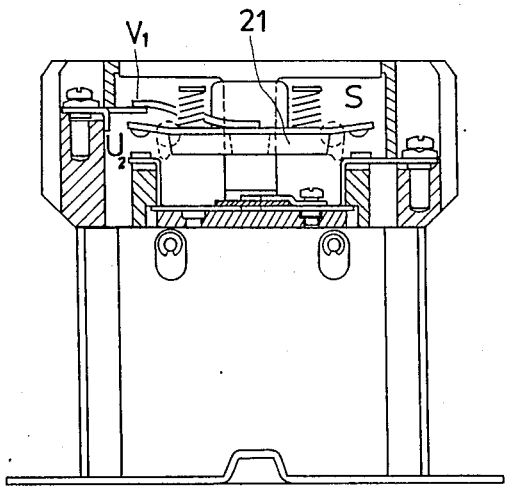

Referring to FIGS. 8A and 8B which show a sectional view of the starter taken along line C—C in FIG. 3A, it is evident that when the movable body 21 is drawn to move downwardly the conduction plate will cause the contact S to touch the fixed contact in the fixed member. The electric power will then be fed to the motor through the conduction plate.

If a reverse rotation of the reversible motor is required, one can easily to flip the switch to a second reverse rotation position and the second electric magnetic coil 52 will then be actuated to cause the movable body 21 to move downward in another direction forming a circuitry of reverse rotation of the reversible motor.

Although the starter for a reversible motor of the present invention has been described hereinabove by way of preferred embodiments, it is still to be noted that changes and modifications can still be made by those who are skilled in the art without departing from the spirit of the present invention.

What is claimed is:

1. A starter for a reversible motor comprising:

an outer casing for the installation of a plurality of operating members;

a movable member having numerous sets of movable contacts attached on one surface thereof;

a fixed member having a cavity formed therein for securing a plurality of sets of fixed electric contacts corresponding to said sets of movable contacts of said movable member;

means for positioning said movable member with respect to said fixed member so that corresponding contacts are normally in an open position and also act as a fulcrum of the movement of the movable member, said positioning means comprising a plurality of pins protruding from one surface of the movable member and corresponding pins being located in said fixed member and bias springs being sleeved onto and between said pins;

a plurality of flexible conduction plates connected to said fixed contacts in said fixed member to form an appropriate power feeding circuitry; and a pair of electromagnets each having at least a movable iron core portion which is linked to one end of said movable member, thereby when one of the electromagnets is actuated, one of said sets of movable contacts and fixed contacts arranged to come in contact, correspondingly closing one of a forward rotation and reverse rotation circuit for a reversible motor.

2. A starter for a reversible motor comprising:

an outer casing for the installation of a plurality of operating members;

a movable member having numerous sets of movable contacts attached on one surface thereof;

a fixed member having a cavity formed therein for securing a plurality of sets of fixed electric contacts corresponding to said sets of movable contacts of said movable member;

means for positioning said movable member with respect to said fixed member so that corresponding contacts are normally in an open position and also act as a fulcrum of the movement of the movable member;

a plurality of flexible conduction plates connected to said fixed contacts in said fixed member to form an appropriate power feeding circuitry;

a pair of electromagnets each having at least a movable iron core portion which is linked to one end of said movable member, thereby when one of the electromagnets is actuated, one of said sets of movable contacts and fixed contacts come in contact, correspondingly closing one of a forward rotation and reverse rotation circuit for a reversible motor; and at least two of said sets of movable contacts forming the actuation electric circuit of the electromagnets, said movable member including a protrusion which will cause one of the actuation circuits to be opened by pushing to isolate a flexible conduction plate with respect to said fixed contact.

3. A starter for a reversible motor comprising:

an outer casing for the installation of a plurality of operating members;

a movable member having numerous sets of movable contacts attached on one surface thereof;

a fixed member having a cavity formed therein for securing a plurality of sets of fixed electric contacts corresponding to said sets of movable contacts of said movable member;

means for positioning said movable member with respect to said fixed member so that corresponding contacts are normally in an open position and also act as a fulcrum of the movement of the movable member;

a plurality of flexible conduction plates connected to said fixed contacts in said fixed member to form an appropriate power feeding circuitry; and a pair of electromagnets each having at least a movable iron core portion which is linked to one end of said movable member by a pair of linking plates each having openings thereon for securing purposes; thereby when one of the electromagnets is actuated, one of said sets of movable contacts and fixed contacts arranged to come in contact, correspondingly closing one of a forward rotation and reverse rotation circuit for a reversible motor.

4. A starter for a reversible motor according to claim 1, 2, or 3, wherein said plurality of flexible conduction plates is in the shape of a bow.

5. A starter for a reversible motor according to claim 1, 2, or 3, further comprising an adjustable screw fitting into and penetrating a bore on the movable member with a coil spring sleeved onto the protruding portion thereof, which thus prevents said movable member from moving to an undesired position.

* * * * *